United States Patent [19]

Terai et al.

[11] Patent Number: 5,051,350

[45] Date of Patent: Sep. 24, 1991

[54] PROCESS FOR PREPARING A SILVER HALIDE EMULSION

[75] Inventors: Fumitaka Terai, Saitama; Hiroyuki Yamagami, Kanagawa; Nobuhiko Uchino, Kanagawa; Masaki Okazaki, Kanagawa, all of Japan

[73] Assignee: Fuji Photo Film Co., Ltd., Kanagawa, Japan

[21] Appl. No.: 378,931

[22] Filed: Jul. 12, 1989

[30] Foreign Application Priority Data

Jul. 12, 1988 [JP] Japan ..... 63-171877

[51] Int. Cl.[5] ..... G03C 1/015; G03C 1/38

[52] U.S. Cl. ..... 430/569; 430/546; 430/570

[58] Field of Search ..... 430/569, 546, 570

[56] References Cited

U.S. PATENT DOCUMENTS

| | | | |
|---|---|---|---|
| 3,912,517 | 10/1975 | Van Poucke et al. | 430/546 |
| 4,006,025 | 2/1977 | Swank et al. | 430/567 |
| 4,211,836 | 7/1980 | Yoneyama et al. | 430/569 |
| 4,474,872 | 10/1984 | Onishi et al. | 430/512 |

*Primary Examiner*—Charles L. Bowers, Jr.
*Assistant Examiner*—Mark R. Buscher
*Attorney, Agent, or Firm*—Sughrue, Mion, Zinn, Macpeak & Seas

[57] ABSTRACT

A process for preparing a silver halide emulsion, which comprises dissolving one or more substantially water-insoluble photographic additives in a heated solution of an organic solvent containing a surfactant having a hydrophilic —$CO_3$ or —$OSO_3$ group to completely dissolve the one or more substantially water-insoluble additives, cooling the resulting solution to precipitate crystals, separating the crystals from the solution, drying the separated crytals, dispersing said crystals in water and adding the resulting dispersion to a silver halide emulsion.

9 Claims, 1 Drawing Sheet

PROCESS FOR PREPARING A SILVER HALIDE EMULSION

FIELD OF THE INVENTION

This invention relates to a process for preparing a silver halide emulsion and more particularly to a process for adding substantially water-insoluble photographic additives to a silver halide emulsion by altering the crystalline state of the substantially waterinsoluble photographic additives and then adding an aqueous dispersion thereof to a silver halide emulsion.

BACKGROUND OF THE INVENTION

Conventional methods for adding water-insoluble photographic additives to photographic silver halide emulsions include methods wherein a solution of the waterinsoluble photographic additives in an organic solvent is added to water, or to an aqueous solution containing an anionic surfactant, or to an aqueous solution containing an aqueous binder, or to a hydrophillic colloid solution to thereby crystallize the water-insoluble additives. The crystallized additives are brought into easily dispersible crystal states and then dispersed. The resulting dispersion is added to a silver halide emulsion.

Methods of mechanical dispersion them are described, for example, in U.S. Pat. No. 3,788,857, JP-A-50-11419 (the term "JP-A" as used herein means an "unexamined published Japanese patent application"), U.S. Pat. No. 3,660,101 and JP-B-49-46416 (the term "JP-B" as used herein means an "examined Japanese patent publication").

A method for forming a dispersion of waterinsoluble additives in water by removing the organic solvent after recrystallization is described in JP-A-49-128725.

Further, JP-B-61-45217 discloses a method different from the above-described methods wherein substantially water-insoluble photographic additives are mechanically dispersed in water at a pH of 6 to 8 and at a temperature of 60 to 80° C in the absence of any organic solvent or surfactant and the resulting dispersion is then added to a silver halide emulsion.

When the water insoluble photographic additives are dissolved in organic solvents, and particularly when additives which are also poorly soluble in organic solvents are used, agglomerates tend to form resulting in streaks or lumps in the emulsion coating since large amounts of the organic solvents are used to dissolve the additives.

In the method wherein the dispersion is formed in water by removing the organic solvents after recrystallization, the organic solvents are removed by evaporation or by a separation method employing a membrane. The resulting solution after evaporation causes variability in concentration and the resulting composition is decomposed. The solution obtained by separation using a membrane also causes variability in concentration. Further, the method manufacturing process is complicated. In the method disclosed in JP-B-61-45217, some additives are left behind as coarse crystals (5 to 30 $\mu$) without having been dispersed. It has been found that some additives can not be mechanically dispersed unless their crystal states are altered by any method.

The present inventors have previously proposed a process for preparing a silver halide emulsion, which solves the above-described problems, does not form lumps or streaks in the coating of the emulsion, causes neither variability in the concentration of the solution nor results in the decomposition of the composition, and allows the water-insoluble photographic additives to be easily dispersed and added to the emulsion. Namely, the present inventors have previously proposed a process for preparing a silver halide emulsion, which comprises dissolving substantially water-insoluble photographic additives in a mixed solution consisting of an organic solvent, a surfactant having hydrophilic $-SO_3$ or $-OSO_3$ groups and optionally, a small amount of a base or small amounts of a base and an acid, by heating the resulting adding the solution dropwise into water to recrystallize the substantially water-insoluble photographic additives, dispersing the additives by highspeed agitation, and adding the resulting dispersion to a silver halide emulsion.

Using the above method, it has been found that lumps or the streaks tend to form in the emulsion coating, and that this problem is caused by the organic solvent contained in the dispersion which is added to the silver halide emulsion. Thus, it is highly desirable to provide a method wherein the substantially water-insoluble photographic additives are added to the emulsion in the absence and an organic solvent to eliminate the above problem.

SUMMARY OF THE INVENTION

An object of the present invention is to provide a process for preparing a silver halide emulsion which solves the above-described problems, does not form lumps or streaks in the emulsion coating, causes neither variability in the concentration of the additives in the dispersion added to the emulsion nor the decomposition thereof, by adding the water-insoluble photographic additives to the emulsion in the absence of an organic solvent. The above-described object of the present invention has been achieved by providing a process for preparing a silver halide emulsion comprising the steps of dissolving one or more substantially water-insoluble photographic additives in a heated solution of an organic solvent containing a surfactant having a hydrophilic $-SO_3$ or $-OSO_3$ group to completely dissolve the one or more substantially water-insoluble additives, cooling the resulting solution to precipitate crystals, separating said crystals from the solution, drying the separated crystals, dispersing the crystals in water, and adding the resulting dispersion to a silver halide emulsion.

BRIEF DESCRIPTION OF THE DRAWINGS

FIG. 3 (*b*) is a schematic drawing of a dissolver blade for use in the process of the present invention.

DETAILED DESCRIPTION OF THE INVENTION

The process of the present invention is illustrated in detail below.

In the process of the present invention, substantially water-insoluble photographic additives are dissolved in an organic solvent containing a surfactant. The additives are completely dissolved by heating the mixture to a temperature of 70 to 90° C accompanied by stirring. The additives remain in solution at a temperature of not lower than 40° C, but when the solution is cooled to below 40° C, crystals are begin to precipitate. It is preferable to cool the solution gradually from 40° C to 20° C. This is because active crystalline surfaces are formed during the course of the growth of crystals by gradual cooling such that the surfactant is sufficiently adsorbed (e.g., 5 to 10 wt% per added photographic additive) on the surfaces of the crystals. Sufficient adsorption means that the recrystallized photographic additives thus modified can be dispersed in an aqueous system by the process of the present invention. The crystals thus obtained by precipitation are of indefinite form (which does not show a remarkable heat absorption peak by a differential thermal analysis and which has not a regular crystal structure but has many projections) due to the surfactant being adsorbed thereon and are readily dispersed in an aqueous system. Alternatively, a relatively incompatible solvent may be added to the heated solution with vigorous stirring, and gradual cooling is then initiated to accelerate the growth of the crystals.

In the present invention, after the precipitation of the crystals, the crystals are separated from the mother liquor. The above solid-liquid separation may be carried out by using a centrifugal separator or Nutsche filter, or by other suitable means.

The separated crystals are dried to completely remove the organic solvent. For this purpose, vacuum drying is preferred.

Figure 3A:
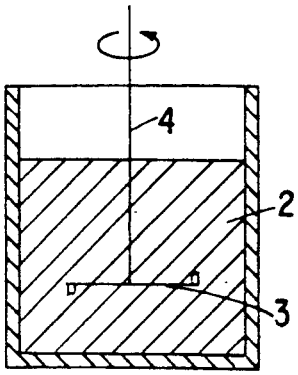
FIG. 3 (*a*) is a cross-sectional view of a highspeed agitator for use in the process of the present invention.
Figure 3B:
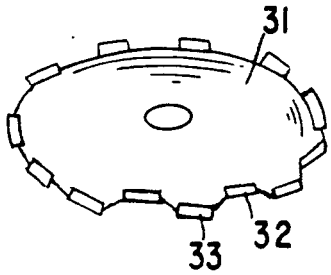

In the present invention, the dried crystals are dispersed in water. A dispersion method of the present invention is described as follows. First, the pH of a dispersion medium is adjusted with NaOH to 7. Next, dispersion medium 2 at a temperature of 50° C is introduced into a tank 1-(see, FIG. 3*a* and 3*b*). An agitating blade 3 is attached to a turning shaft 4. A dissolver blade is preferably used as an agitating blade 3. The dissolver blade has a disc blade 31 provided with alternate downward vertical blades 32 and upward vertical blades 33. The ratio of the diameter of the dissolver blade to the inner diameter of the tank is preferably from 1:5 to 2:5, the ratio of the diameter of the dissolver blade to the gap between the bottom of the tank and the dissolver blade is preferably from 2:1 to 1:1, and the ratio of the diameter of the dissolver blade to the height of the non-stirred, still liquid in the tank is preferably from 1:1 to 1:3. The dispersion medium 2 in the tank 1 is preferably dispersed over a period of about two hours using highspeed agitation at 3,000 r.p.m.

The process of the invention is illustrated in detail below.

The substantially water-insoluble photographic additives for use in the present invention are solid additives. Substantially water-insoluble additive means that not more than 0.1 grams of the additive will dissolve in 100 grams of water at a temperature of 50° C. Examples of the solid additives include spectral sensitizing dyes, anti-fogging agents, color couplers, dyes, sensitizing agents, hardening agents, ultraviolet light absorbers, antistatic agents, bleaching agents, desensitizers, developing agents, anti-fading agents, mordants, etc. These additives are described in Research Disclosure, Vol. 176, RD-17643, pages 22–31 (Dec. 1978).

Examples of the spectral sensitizing agents for dispersion by the method of the present invention include methine dyes, cyanine dyes, merocyanine dyes, hemicyanine dyes, rhodacyanine dyes, oxonol dyes, hemioxonol dyes and styryl dyes. Anion dyes such as dyes having at least one, preferably two or more sulfo or sulfoalkyl groups as substituent groups are particularly effective.

The spectral sensitizing agents described in German Patent 929,080, U.S. Pat. Nos. 2,493,738, 2,503,776, 2,519,001, 2,912,329, 3,656,959, 3,672,897, 3,694,217, 4,025,349, 4,046,572, 2,688,545, 2,977,229, 3,397,060, 3,522,052, 3,527,641, 3,617,293, 3,628,964, 3,666,840, 3,672,898, 3,679,428, 3,703,377, 3,814,609, 3,837,862 and 4,026,707, U.K. Patents 1,242,588, 1,344,281 and 1,507,803, JP-B-44-14030, JP-B-52-24844, JP-B-43-4936, JPB-53-12375, JP-A-52-110618, JP-A-52-109925 and JP-A-50-80827 can also be effectively dispersed by the method of the present invention in addition to those described in the aforesaid literature.

In addition to the spectral sensitizing agents, the process of the present invention is applicable to benzotriazole compounds, 4-thiazolidone compounds, benzophenone compounds, cinnamic ester compounds, butadiene compounds, benzoxazole compounds, cationic polymers, chromium salts, aldehydes, N-methylol compounds, dioxane derivatives, active vinyl compounds, active halogen compounds, mucohalogen acids, nitroindazoles, triazoles, benzotriazoles, benzimidazoles, mercaptothiazoles, mercaptobenzothiazoles , tetraazaindenes, 5-pyrazolone couplers, pyrazolone benzimidazole couplers, acylacetamide couplers, naphthol couplers and phenol couplers.

The amounts of the substantially water-insoluble additives to be added to the silver halide emulsion vary depending on the types of additives, the amount of the silver halide, etc., but is generally an amount equal to that which would be conventionally used. For example, the addition amount is 0.003 to 0.3 g per 100 g of silver halide emulsion.

When the water-insoluble additives are cyanine spectral sensitizing dyes, the process of the present invention is particularly effective. An example of such a water-insoluble cyanine dye is the compound (hereinafter referred to as dye A) represented by the following formula.

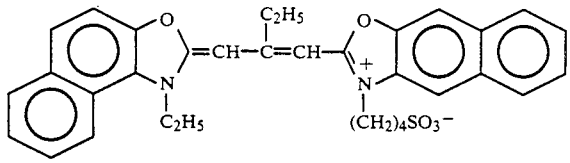

Preferred organic solvents for use in the process of the present invention include alcohols such as aliphatic saturated alcohols (e.g., methanol, ethanol, isopropyl alcohol), aliphatic unsaturated alcohols (e.g., allyl alcohol), alicyclic alcohols (e.g., cyclohexanol), aromatic alcohols (e.g., 2-phenyl ethanol) and heterocyclic alcohols (e.g., furfuryl alcohol, tetrafurfuryl alcohol). Among them, aromatic primary alcohols and halogenated alcohols are preferred. Benzyl alcohol ($C_6H_5CH_2OH$) and fluorinated alcohols (e.g., $HCF_2CF_2CH_{20}H$ or $CF_3CH_2OH$) are particularly preferred.

Examples of the surfactants having a hydrophilic $-SO_3$ or $-OSO_3$ group for use in the process of the present invention, include anionic surfactants such as alkylsulfates (e.g., $C_{12}H_{25}OSO_3Na$), alkylsulfonates (e.g., $C_{12}H_{25}SO_3Na$), alkylarylsulfonates (e.g.,

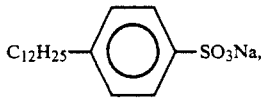

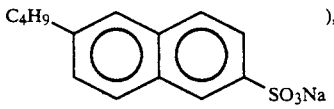

), and sulfosuccinic ester salts $$\text{(e.g., } NaO_3S-\overset{\displaystyle CH_2COOCH_2CH(C_2H_5)C_4H_9}{\overset{|}{CH}}COOCH_2CH(C_2H_5)C_4H_9\text{).}$$

Among them, the compound (hereinafter referred to as surfactant D) represented by the following formula is particularly preferred.

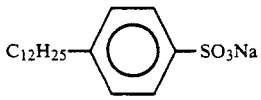

The amount of each of the organic solvent and the surfactant having a hydrophilic $-SO_3$ or $-OSO_3$ group present in the mixed solution thereof (i.e., the heated solution) varies depending on the type of organic solvent and the surfactant employed. The amount of the surfactant present in the mixed solution is generally from 25 to 100% by weight, preferably 25 to 75% by weight of the additives. The amount of the organic solvent present in the mixed solution is generally from about $\frac{1}{3}$ to $\frac{1}{2}$ the amount required to dissolve the additives in the organic solvent alone at 70 to 80° C.

Any of silver bromide, silver iodobromide, silver iodochlorobromide, silver chlorobromide and silver chloride can be used as the silver halide of the emulsion of the process of the present invention. Although there is no particular limitation with regard to the grain size of the silver halide, a grain size of not larger than 3 $\mu$ is preferred. The silver halide emulsions for use in the process of the present invention are readily prepared by methods described in literature such as Chimie et Physique Photographique, written by P. Glafkides (Paul Montel, 1967), Photographic Emulsion Chemistry, written by G. F. Duffin (The Focal Press, 1966) and Making and Coating Photographic Emulsion, written by V.L. Zelikman et al. (The Focal Press, 1964).

An acid process, neutral process or ammonia process can be used to prepare the silver halide emulsion. The soluble silver salt and halide salt used to form the silver halide grains can be reacted by the single jet process, double jet process or a combination thereof.

A reverse mixing method can be used in which grains are formed in the presence of an excess amount of silver ion. The controlled double jet process may also be used in which the pAg value in the liquid phase wherein the silver halide is formed is kept constant.

By using the controlled double jet process, a silver halide emulsion is obtained having a regular crystal structure and an almost uniform grain size.

Two or more silver halide emulsions may be separately prepared and then mixed.

If desired, cadmium salt, zinc salt, lead salt, thallium salt, iridium salt or complex salt, rhodium salt or complex salt, or iron salt or complex salt may coexist during the formation of the silver halide grains or during the physical ripening thereof.

The silver halide emulsion for use in the process of the present invention may contain other additives such as sensitizing agents (e.g., sulfur sensitizing agent, reduction sensitizing agent, noble metal sensitizing agent), stabilizers, surfactants, hardening agents, thickeners, dyes, ultraviolet absorbing agents, antistatic agents, bleaching agents, desensitizers, developing agents, antifading agents, mordants, etc. Further, dispersions of couplers such as color couplers dispersed in an oil can be present in the silver halide emulsion for use in the present invention.

These additives and methods of employment thereof are described, for example, in Research Disclosure (RD-17643), Vol. 176, pages 22 to 31 (December 1978) and The Theory of The Photographic Process (4th Ed.), edited by T.H. James (1977, Macmillan Publishing Co., Inc.).

A preferred binder for use in the silver halide emulsion of the process of the present invention is gelatin. In addition to gelatin, gelatin derivatives (e.g., phthalated gelatin), albumin, agar, gum arabic, cellulose derivatives, polyvinyl acetate, polyacrylamide and polyvinyl alcohol can also be used as binders.

In the preparation of the silver halide emulsion according to the method of the present invention, the organic solvent is weighed and introduced into a dispersing tank. The surfactant is added thereto. The mixture is stirred at room temperature by means of an agitating element. For example, the agitating element may be a turbine blade provided with four blades on an agitating shaft. The ratio of the diameter of the turbine blade to the inner diameter of the tank is preferably from about 1:5 to 2:5, the ratio of the diameter of the turbine blade to the gap between the bottom of the tank and the turbine blade is preferably from about 2:1 to 1:1; and the ratio of the diameter of the turbine blade to the height of the non-stirred still liquid in the tank is preferably from about 1:1 to 1:3. The agitating blade is not limited to a turbine blades. Other agitating elements such as paddle blade, propeller blades and dissolver blades can be used. Further, a magnetic stirrer may be used, when a small amount of the emulsion is being prepared.

After a solution of the organic solvent and the surfactant having a hydrophilic $-SO_3$ or $-OSO_3$ group is prepared by stirring, the solution is heated to a temperature of 70 to 80° C. The one or more photographic additives are then added to the heated solution. The mixture is stirred at 70 to 80° C to dissolve the additives. After the additives are completely dissolved, stirring is stopped and the resulting solution is gradually cooled to 20° C. Crystals begin to precipitate at about 40° C. Gradual cooling from 80° C to 25° C for one hour is conducted to thereby form active crystalline surfaces during the growth of the crystals and to allow the surfactant to be sufficiently adsorbed thereon.

Once the crystal precipitation is completed, solid-liquid separation is carried out by, for example, centrifugal separation or filtration. The separated crystals are then dried in vacuo (1 to 20 Torr) at 25 to 40° C for 12 to 24 hours to completely remove the organic solvent.

The completely dried crystals are then added to water, and the mixture is heated to a temperature of from 40 to 60° C. The pH of the resulting mixture is adjusted to from 6.5 to 7.5 with NaOH (1N) and the crystals are dispersed over a period of about two hours by using highspeed agitation at about 3,000 r.p.m.

If desired, dispersion may be accelerated by adding other photographic additives to the water which are well-dispersible in water together with the crystals. Well-dispersible means that the additive is easily dispersed in water by mechanical means (e.g., agitation) without resort to wetting agents or dispersants.

Examples of photographic additives which are well-dispersible in water include the following dyes.

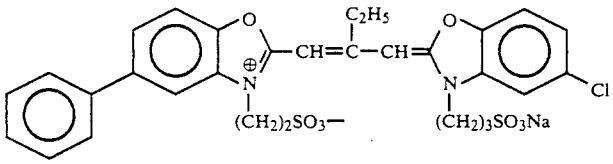

(hereinafter referred to as dye B)

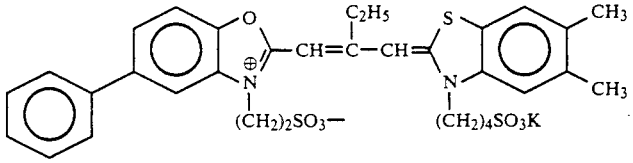

(hereinafter referred to as dye C) and

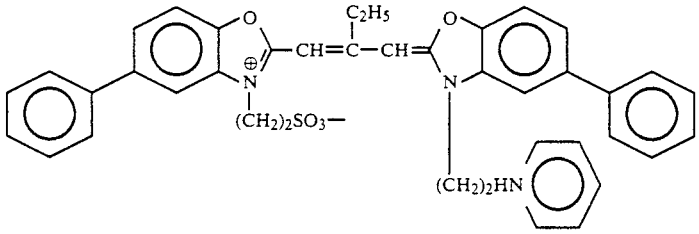

(hereinafter referred to as dye D)

The resulting dispersion may be added directly to the silver halide emulsion. Alternatively, the dispersion may be first mixed with a protective colloid and the resulting mixture in the form of a solution or gel may be added to the emulsion. In either manner, the desired photographic performance can be obtained.

The addition amount of well-dispersible dye is from 1 to 10 g per gram of poorly dispersible dye (additive).

Preferred embodiments of the present invention are as follows:

(1) A process for preparing a silver halide emulsion as in claim 1 of the present invention, wherein the photographic additives are cyanine spectral sensitizing dyes.

(2) A process as in claim 1 of the present invention or the above embodiment (1), wherein the amount of the surfactant having a hydrophilic $-SO_3$ or $-OSO_3$ group is present in the heated solution in an amount of from 25 to 75% by weight based on the amounts of the additives.

(3) A process as in claim 1 of the present invention or the above embodiments (1), (2) or (3), wherein the recrystallized crystals are dispersed in water, together with one or more photographic additives which are welldispersible in water.

The process of the present invention is illustrated below by means of the following non-limiting example.

COMPARATIVE EXAMPLE 1

1.59 g of the above-mentioned substantially waterinsoluble dye A, 8.12 g of the above-mentioned dye B which is well-dispersible in water and 0.3 g of the abovementioned dye C which is also well-dispersible in water, were added to 500 ml of water. The mixture was heated to 50° C and the pH thereof was adjusted to 7. The dyes were then dispersed over a period of two hours using a highspeed agitator provided with dissolver blade at 3000 r.p.m. as shown in FIG. 3.

EXAMPLE 1

(1) The surfactant D having a hydrophilic $-SO_3$ group was added to 100 g of a fluorinated alcohol ($HCF_2CF_2CH_2OH$) as an organic solvent and the mixture was stirred at room temperature by using a turbine blade agitator to dissolve the surfactant.

(2) 10 g of the dye A as a substantially waterinsoluble additive was added to the resulting solution, and the mixture was stirred at a temperature of 80 to 85° C. for 20 minutes using the above turbine blade agitator to prepare a solution of the surfactant D, the dye A and the fluorinated alcohol.

(3) 100 g of ethyl acetate as a incompatible solvent was added to the resulting solution at a temperature of 75 to 80° C to facilitate recrystallization. The mixture was gradually cooled to 25° C over a period of one hour.

(4) The solution was fed to a centrifugal separator to separate the precipitated crystals from the mother liquor.

(5) The separated crystals were dried at room temperature under a vacuum of 2 to 3 mg Hg for 24 hours to thereby completely remove the organic solvent. The resulting modified dye A was quantitatively analyzed by means of liquid chromatography. The analysis showed that the modified dye A consisted of 93.8% by weight of the dye A and 6.2% by weight of the surfactant adsorbed thereto.

(6) 1.70 g of the thus-obtained modified dye A together with 8.12 g of the dye B and 0.3 g of the dye C were added to 500 ml of water. The mixture was heated to 50° C. and the pH thereof was adjusted to 7. The additives were then dispersed over a period of two hours using a high-speed agitator at 3,000 r.p.m. as in Comparative Example 1.

The aqueous dispersion of Example 1 was compared with that of Comparative Example 1 by means of a 400 x magnified light microphotograph. It was found that in Comparative Example 1, coarse crystal grains of size of about 10 μ visually covered an area of at least 25% and the dispersion was considered to be poor. In Example 1 of the present invention, the grain size of the dispersed crystals was 1 μ or smaller and the crystal grains were uniformly dispersed.

Figure 1:
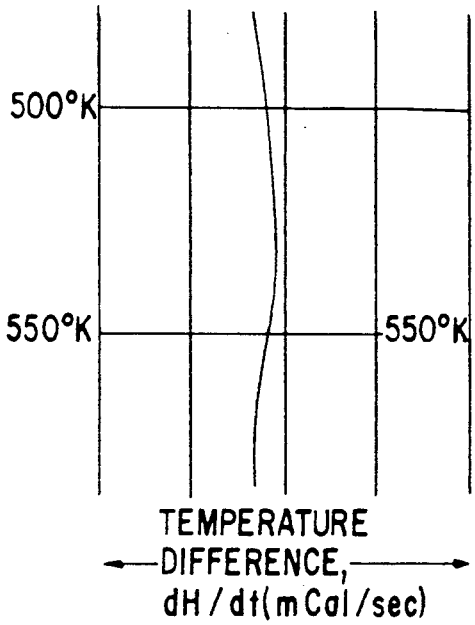
FIG. 1 is a diagram of a differential scanning calorimetric analysis of the crystal of Example 1 of the process of the present invention after modification.
Figure 2:
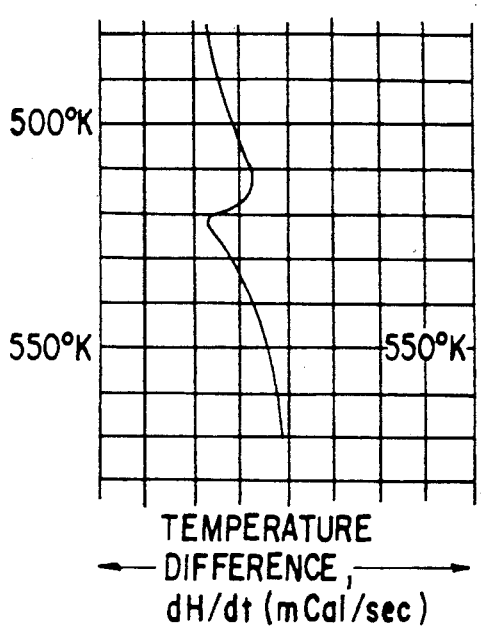
FIG. 2 is a diagram of a differential scanning calorimetric analysis of the crystal of Comparative Example 1 before modification.

The crystals of Example 1 and Comparative Example 1 were also examined by means of a differential scanning calorimeter (DSC). The modified crystal of the process of the present invention were characterized as not having a heat absorption peak and were indefinite crystals as shown in FIG. 1, while the conventional unmodified crystals were characterized as having a heat absorption peak at 520° C. as shown in FIG. 2.

Each of the dispersions of Example 1 and Comparative Example 1 were added to a silver halide emulsion. Specifically, 15 g of dispersion was added to 100 g of silver iodobromide emulsion (average particle diameter: 1 μm). The resulting emulsions were coated. The emulsion containing the dispersion of Example 1 exhibited a satisfactory performance and did not cause any coating irregularities.

In the process for the preparation of a silver halide emulsion according to the present invention, organic solvents are not added to the silver halide emulsion. This manner of addition avoids the formation of precipitates, etc. during the coating of the emulsion.

The amount of the surfactant to be added is relatively small (about 5 to 10 wt.% based on the total amount of the photographic additives) such that adverse effects on high-speed coating are avoided. For example, the emulsion prepared by the process of the present invention remains stable (which does not occur the decomposition of the additive) and the coated emulsion has good adhesion with the support.

The present invention enables photographic additives to be added to a silver halide emulsion as aqueous dispersions, said additives being poorly dispersible have been conventionally added to the silver halide emulsion only by first dissolving the additives in organic solvents.

An improvement in the quality of the silver halide emulsion is thus achieved by the process of the present invention.

While the invention has been described in detail and with reference to specific embodiments thereof, it will be apparent to one skilled in the art that various changes and modifications can be made therein without departing from the spirit and scope thereof.

What is claimed is:

1. A process for preparing a silver halide emulsion, comprising the steps of:

dissolving one or more substantially water-insoluble photographic additives in a heated solution of an organic solvent containing a surfactant having a hydrophillic $-SO_3$ group or $-OSO_3$ group at a temperature of 70° C. to 90° C. to completely dissolve the one or more substantially water-insoluble photographic additives, cooling the resulting solution to below 40° c. to precipitate crystals, separating said crystals from the solution, drying the separated crystals, dispersing said crystals in water, and adding the resulting dispersion to a silver halide emulsion.

2. A process as in claim 1, wherein the surfactant is present in the heated solution in an amount of from 25 to 75% by weight of the one or more substantially water-insoluble photographic additives.

3. A process as in claim 1, wherein at least one other photographic additive which is well-dispersible in water is added to the dispersion.

4. A process as in claim 1, wherein the organic solvent is present in the heated solution in an amount of from ⅓ to ½ the amount required to dissolve the one or more substantially water-insoluble photographic additives in the organic solvent alone.

5. A process as in claim 1, wherein the solution of the organic solvent containing the surfactant and the one or more substantially water-insoluble photographic additives is cooled to 20° C. in the cooling step.

6. A process as in claim 1, wherein the surfactant is adsorbed onto the precipitated crystals.

7. A process as in claim 1, wherein the surfactant is an anionic surfactant selected from the group consisting of alkylsulfates, alkylsulfonates, alkylarylsulfonates and sulfosuccinic ester salts.

8. A process as in claim 1, wherein the organic solvent is an alcohol selected from the group consisting of aliphatic saturated alcohols, aliphatic unsaturated alcohols, alicyclic alcohols, aromatic alcohols and halogenated alcohols.

9. A process as in claim 1, wherein the substantially water-insoluble additive is a cyanine dye.

* * * * *